US005088882A

United States Patent [19]

Lovitt, Jr.

[11] Patent Number: 5,088,882

[45] Date of Patent: Feb. 18, 1992

[54] UNIVERSAL COUPLING

[76] Inventor: Estel L. Lovitt, Jr., 5102 Brendon Way, Sylvania, Ohio 43560

[21] Appl. No.: 200,356

[22] Filed: May 31, 1988

[51] Int. Cl.[5] ..... E02F 9/00

[52] U.S. Cl. ..... 414/723; 172/273

[58] Field of Search ..... 414/723; 172/272-275

[56] References Cited

U.S. PATENT DOCUMENTS

| | | | |
|---|---|---|---|
| 3,760,883 | 9/1973 | Birk | 414/723 X |
| 4,203,238 | 5/1980 | Bangert et al. | 414/723 X |
| 4,345,870 | 8/1982 | Anderson et al. | 414/686 |
| 4,480,955 | 11/1984 | Andrews et al. | 414/723 |
| 4,708,579 | 11/1987 | Baird et al. | 414/723 |
| 4,810,162 | 3/1989 | Foster | 414/723 |
| 4,858,345 | 8/1989 | Abe et al. | 37/118 R |
| 4,963,071 | 10/1990 | Larwin et al. | 414/723 |

*Primary Examiner*—David A. Bucci
*Assistant Examiner*—Donald W. Underwood
*Attorney, Agent, or Firm*—Geroge R. Royer

[57] ABSTRACT

The subject apparatus is a coupling device utilized and adapted for various work vehicles, and on which is integrally disposed a front end functional or working member capable of a plurality of movement and work functions controlled by the operator of the work vehicle, such coupling device comprising a tandem connecting member which is comprised of a pair of opposing support arms disposed in parallel fashion in a generally upright position, and wherein such support arms diverge in V-shaped fashion on the lower parts thereof, with the lower part of such arms connected by a horizontal bar member, and the outboard sides of the support arms are flanked by identical flanged secondary support members, and these latter members are, in turn, flanked by support collars, with additional connecting means provided to connect the apparatus to the adjoining ears of additional work member to be connected to the work vehicle.

2 Claims, 3 Drawing Sheets

UNIVERSAL COUPLING

DISCUSSION OF PRIOR ART AND BACKGROUND OF INVENTION

The subject invention pertains to the area of coupling mechanisms used as an intermediate member to facilitate the coupling of a work member to a vehicle, with such work member comprising front end loaders, grading and other similar apparatus. In particular, the subject invention is an intermediate coupling apparatus adapted for coupling on the forward portion of a work vehicle a functional device such as a front end loader or other work attachment. Such functional attachments are usually appended in temporary fashion to the front of a vehicle as a working device having a specified function. Such vehicles are generally adapted to have a variety of such work attachments appended thereto, and in general, such working implements are attached to the front of the vehicle. With the ability to temporarily attach such work implements, the work vehicle is provided with a broad functional diversity.

There are several obvious advantages to utilize one vehicle as a base functional member to which a variety of work members can be appended as the need arises. With such a universal coupling device, as envisioned by the invention herein, there is thus no need to retain several vehicles each with a unitary specialized appendage and one vehicle can suffice to which all the work appendages can be attached.

One of the problems in attaching such temporary work implements to the front of an appropriate vehicle is the difficulty with attaining the proper alignment of the working apparatus so as to provide a proper and optimal force and motion flow between the auxiliary power equipment on the vehicle and the work apparatus. Another problem is that such existing coupler devices have a tendency to extend out from the end of the boom to which such coupler is attached so that the boom length is effectively extended, thereby projecting forwardly the work implement, such as a bucket, thus decreasing its efficiency.

The following objects of the subject invention are directed accordingly.

OBJECTS

The objects of the subject invention are as follows:

It is an object of the subject invention to provide an improved coupling device for work vehicles;

Yet another object of the subject invention is to provide an efficient and improved coupling device;

Another object of the subject invention is to provide an improved and versatile coupling device as used on various work vehicles;

Still another object of the subject invention is to provide a device that is a universal coupler for work machines;

A further object of the subject invention is to provide an improved concept of coupling a temporary functional member to a vehicle;

Other and further objects of the subject invention will become apparent from a reading of the following description taken in conjunction with the claim and the drawings.

DRAWINGS

DESCRIPTION OF GENERAL EMBODIMENT AND SUMMARY OF INVENTION

The subject apparatus is a coupling device utilized and adapted for various work vehicles, and on which is integrally disposed a front end functional or working member capable of a plurality of movement and work functions controlled by the operator of the work vehicle, such coupling device comprising a tandem connecting member which is comprised of a pair of opposing support arms disposed in parallel fashion in a generally upright position, and wherein such support arms diverge in V-shaped fashion on the lower parts thereof, with the lower part of such arms connected by a horizontal bar member, and the outboard sides of the support arms are flanked by identical flanged secondary support members, and these latter members are, in turn, flanked by support collars, with additional connecting means provided to connect the apparatus to the adjoining ears of additional work member to be connected to the work vehicle.

DESCRIPTION OF PREFERRED EMBODIMENT

In describing the preferred embodiment of the subject invention, it is to be noted that the following description shall be of one embodiment only of several that are within the scope of the invention herein, and this description of a particular embodiment shall not be considered as limiting the scope of the invention herein. Moreover, in describing the subject invention, the following nomenclature shall be used. The word "upper" shall refer to those areas above the ground level, while the word "lower" will refer to those areas adjacent or near the ground level as appertaining to a vertically disposed device, as described.

Figure 1:
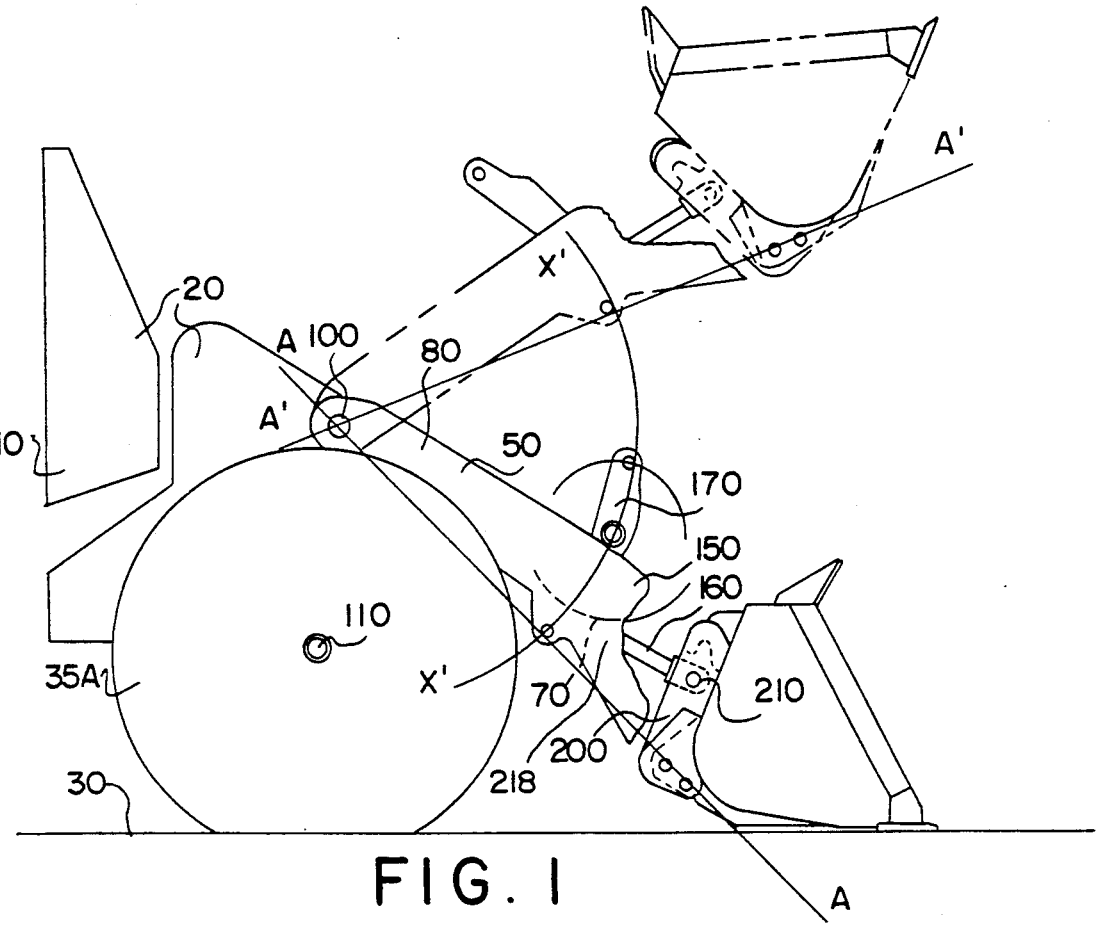
FIG. 1 is a side elevational view of the subject invention, showing the relative position of the coupler to the overall structure to which it is affixed.
Figure 2:
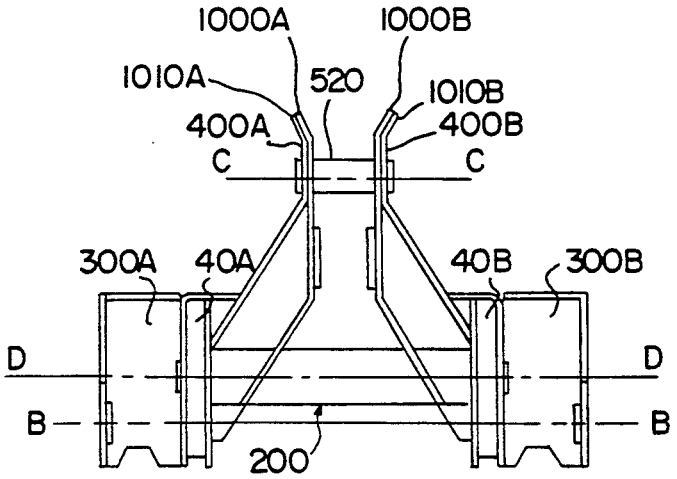
FIG. 2 is a front elevational view of the subject invention.
Figure 2A:
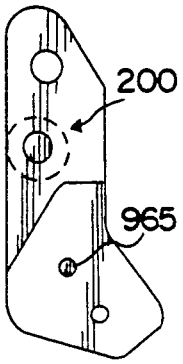
FIG. 2A is a side elevational view of the subject device showing an enlargement of the coupler mechanisms.
Figure 3:
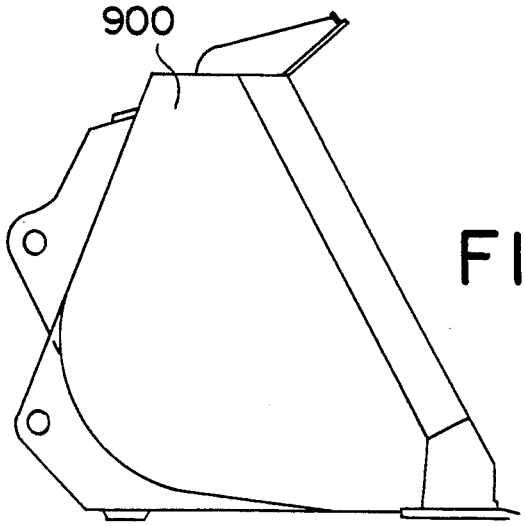
FIG. 3 is a side elevational view of the original loading bucket apparatus to which the subject invention is intended to be.
Figure 4:
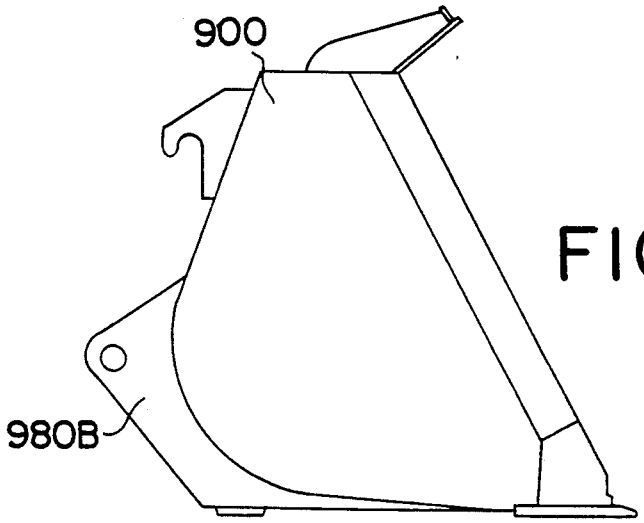
FIG. 4 is a side elevational view of the modification made to the loader bucket apparatus to accommodate the subject invention.

Referring now to the drawings and particularly to FIGS. 1, 2 and 3. The front end of a land-based motorized work vehicle 20 is a conventional self-propepelled vehicle, which vehicle is adapted to be driven over the ground 30 on wheels 35A and over railroad tracks, not shown, on appropriate rail wheels. Such a vehicle 20 may be adapted to be propelled over either ground or on rail tracks, but the subject invention is equally applicable to any type of vehicle. As shown, the vehicle 20 is equipped with a retractable working arm member 50, which is a longitudinal member with a front end 70 and a posterior end 80. As can be seen, posterior end 80 is pivotably mounted on horizontal axial shaft 100. Such a longitudinal shaft 100 is preferably, but not necessarily, positioned above the axle 110 of wheels 35A, as shown.

Moreover, this shaft 110 is positioned above the upper surface of wheels 35A, as particularly shown in FIG. 1.

As can be seen, such working arm 50 is a longitudinally extending arm having a longitudinal base axis A-A. As can be seen from the drawings, the working arm 50 is pivotable upward and downward from the approximate upward position shown at A'-A' to the downward position shown at A-A shown fully in FIG. 1, which is congruous to base axis A-A.

Furthermore, as can be seen in FIG. 1, working arm 50 is comprised of a main shank portion which is basically a straight member with the posterior end 80 embracing the rear flank of such shank member. The upper frontal position 150 of such shank member has a hydraulically actuated lift rod 160 that is hydraulically seated in the front part of the main shank member as shown in FIG. 1. As can be seen in the drawings, the frontal upper part linked to the front end of working arm 50 is pivotable linkage member 170 which is, in turn, coupled to an assist lift element, not shown, which lift element is used to assist lifting the working arm 50, as shown.

Figure 5:
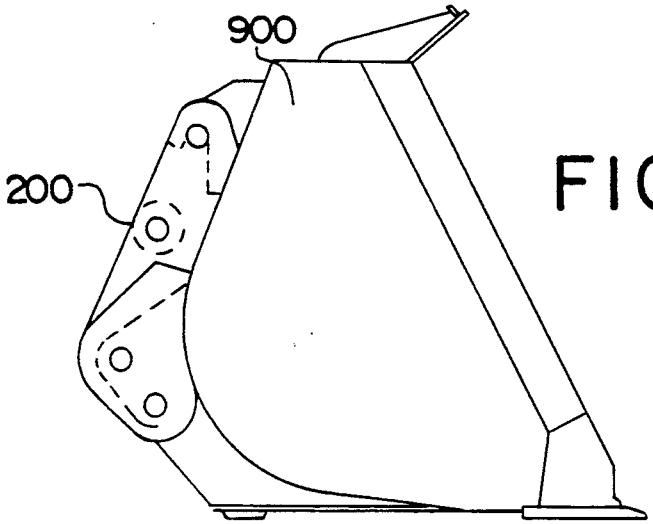
FIG. 5 is a side elevational view of the subject invention shown in the attached coupling device to a loader bucket.

As can be further seen from a view of FIGS. 1, 2 and 5, the coupling mechanism 200 that embodies the subject invention is mounted to the frontal portion of the working arm 50, and is also movable up and down through the limited arcuate sweep as seen in FIG. 1, with coupler mechanism 200 being so independently rotable to a limited degree about the horizontal shaft 210 which is affixed to the front end of the lift rod 160, as shown in FIG. 1. As seen in FIG. 1, the middle portion of the coupling mechanism 200 is pivotably mounted about the horizontal shaft 210 with such shaft 210 also being connected through the frontal extremity of the working arm 50 by rod 160. Thus, the horizontal shaft 210 pivotably connects the coupling member 200 to the working arm 50. As can be seen, the latter pivotal arrangement permits the coupling mechanism 200 to be tilted up or down from the position shown in FIG. 1 thus providing limited flexible movement for the frontally attached working element as more fully discussed below.

Figure 6:
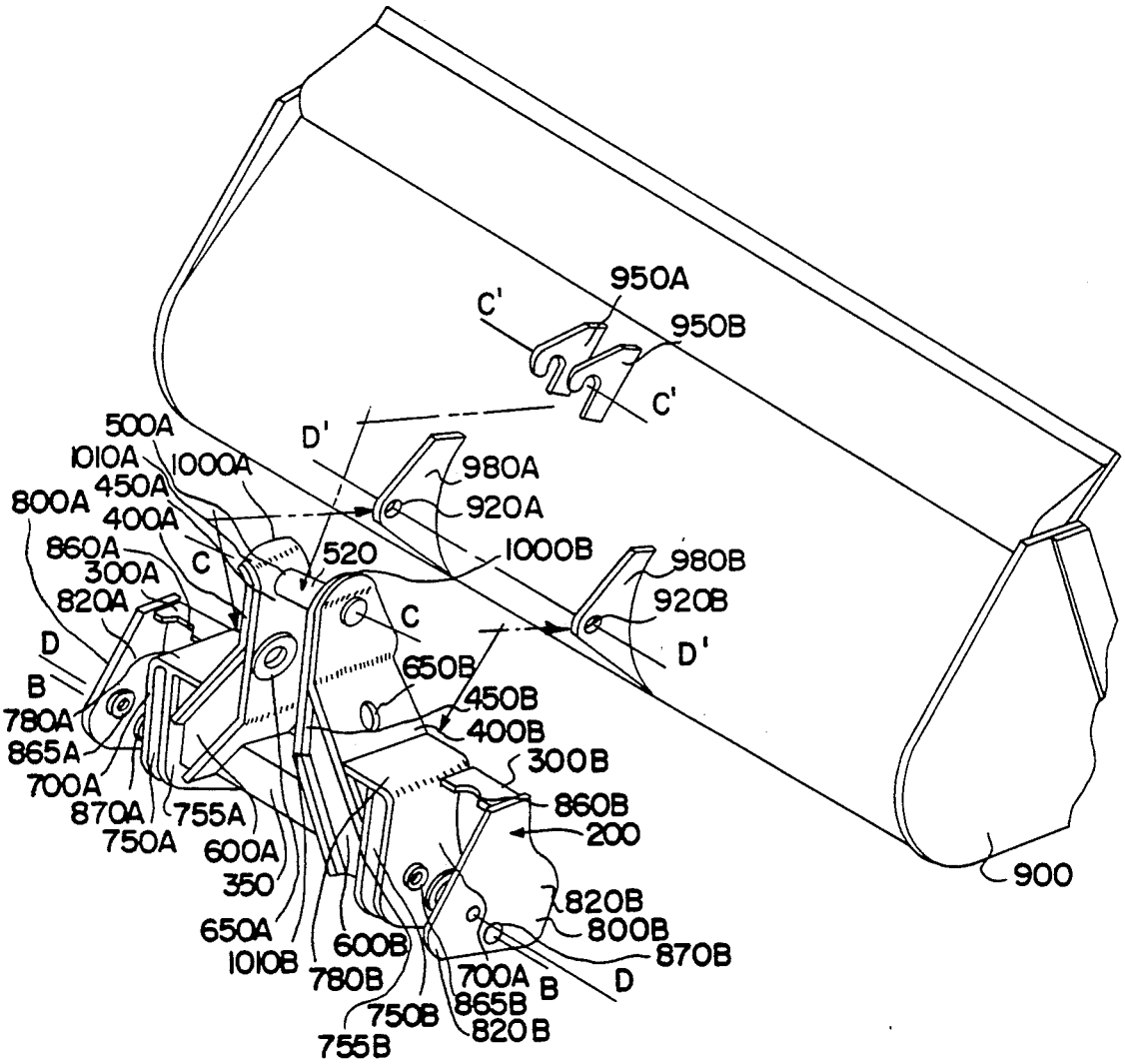
FIG. 6 is a perspective view of the subject invention.

Attention is directed to all the drawings relative to the detailed structure of the coupling member 200. As can be seen, the coupling mechanism is a tandem member comprising a first base element 300A and second base element 300B, with such elements being mirror images of one another as can be seen from FIGS. 2 and 6. As seen in FIG. 6, first base element 300A is to the left of second base element 300B as viewed from the posterior side of such coupling mechanism 200. The first base element 300A will be described in detail with the understanding that the components thereof are identical, in such mirror image fashion, to the second base element 300B, and therefore any component on the first base element 300A will be designated with sub "A" descriptions, and the corresponding component on the second element will have a sub "B" designation, but will not be explicitly described because of such identity.

As can be seen in FIGS. 2 and 6, both the first base element 300A and second base element 300B are basically and generally vertically extending members, both mounted facing one another on horizontal support beam 350, as shown in the drawings. Such support beam serves as the basic horizontal support element for the coupling mechanism 200. As can be seen from the drawings, first base element 300A is comprised in part of a vertically extending support member 400A, and as can be seen, such vertical support member has a flat vertical face 450A facing inboard or facing the comparable inboard face 450B of the mating vertical support member 400B. The upper portion 1000A of the vertical support member 400A is turned outboard slightly as seen, and as can be seen from the drawings the portion of the vertical support member 400A, just beneath that part that is turned outboard has a circular opening 500A extending completely through such vertical support opening. Inserted through such circular opening 500A is a horizontally oriented, cylindrical connecting bar 520 which extends through to the opposing opening 500B in the second vertical support member 400B, as seen. In the preferred embodiment of the subject invention, the connecting bar 520 is fixed against rotating and serves as a first connecting member to the work element as hereinafter described.

As can be seen from FIG. 2, the first vertical support member 400A extends upward as an integral extension of the horizontal support brace 350. The lower outboard portion of the first vertical support member 400A is formed as an angular support extension 600A of such first vertical support member and as can be seen from the drawings, such angular support extension 600A essentially forms an obtuse angled V with the upper or remaining parts of the vertical support member 400A, and such angular support extension 600A diverges downwardly and towards the outboard side of the coupling element 200, as seen in FIG. 6.

At a point that is just above that area where the angular support extension 600A joins with the vertically upright portion of the vertical support member 400A is a second circular reinforced opening 650A, the purpose of which is described below. This latter opening 650A extends completely through the thickness of the vertical support member 400A, so as to be able to receive a horizontal shaft therein.

On the lower outboard portion of the angular support extension 600A is a first flanking brace 700A of vertical disposition. As seen, such first flanking brace 700A is outboard of the first vertical support member 400A and is essentially comprised of a pair of parallel vertical facing plates 750A and 755A. At the upper extreme parts of such facing plates 750A and 755A is a horizontal connecting plate 780A that is affixed horizontally with its lower surface joined integrally to the upper edges of the facing plates 750A and 755A, while the inboard portion of such horizontal connecting plate 780A joins integrally on its inner edge to the adjoining outboard side of the angular support brace 600A, and as can be seen, such horizontal brace overlays the top edges of the flanking plates 750A and 755A forming thereby an L-shaped member. Additionally, the lower part of the flanking plates 750A and 755A integrally join against the lower extremity of the angular support member 600A. Outboard of the first flanking brace 700A is first collar member 800A which comprises a vertical plate 820A joining the upper outer extremity of the first flanking plate by a horizontal plate member. In the posterior portion of such horizontal plate member is a semicircular notch 860A which is formed as a concave indentation.

As can be seen from the drawings, the circular openings 865A, and 870A are formed through the bottom portions respectively of the collar member 800A, the flanking plates 750A and 755A, and the angular support brace 600A. The horizontal brace 350 in the preferred embodiment has a hollow chamber aligned with such latter openings so as to receive a horizontal shaft therethrough.

As can be seen from the drawings, the universal coupler 200 is affixed to the front end of the working arm 50 of vehicle 20 and is affixed to a work element, such as bucket 900 shown in FIG. 6 as follows. First, hooked-shaped extension members 950A and 950B on the rear face of the bucket element are positioned over upper cylindrical bar member. Thence, a longitudinal cylindrical bar is inserted through the openings 920A and 920B in rearwardly extending ears 980A and 980B in lower rear face of the grader as aligned with the openings 870A and 870B in vertical support members 400A and 400B. This locks the grader or work element 900 to the coupling element 200.

As can be seen from the drawings, the upper extremities 1000A and 1000B of the vertical support members 400A and 400B as particularly shown in FIGS. 2 and 6 are curved or bent outwardly with ears 1010A and 1010B respectively, such ears forming a V-shaped trough-like effect.

In summary, the subject invention is a universal coupling device attached to the front end of a motor vehicle for attachment for various work implements to said work vehicle, such device coupling drive comprising in general a longitudinally extending base member having a longitudinal central axis and a first main support member and second main support member, each such main support members having an upper portion and a lower portion with both such support members being vertically disposed members being parallel to one another in tandem fashion, both such main support members being integrally affixed on their respective lower portions to such base member, such first main support member and such second main support member each having a transverse opening in the upper portion wherein such transverse openings in the upper portions of such first and second main support members are coaxially aligned along a common axis, as seen as being axis C-C in FIG. 6, which then becomes aligned along axis C'-C' in FIG. 6 on the loading bucket 900, and wherein such first main support member and such second main support member each having a second transverse opening disposed in that portion of the vertical main support members at a portion thereof above the base support member, such second transverse openings being 650A and 650B in FIG. 6. The main support members having additional openings along axis D-D in FIG. 6, which openings along such axis D-D are aligned along the axis D'-D' shown in FIG. 6 to pivotably couple the coupling device to the loader 900 through ears 980A and 980B therein, in such respective main support members being coaxially aligned along a common axis, and a first secondary vertical support member and a second vertical secondary support member with the first such secondary vertical support member being integrally affixed in a position immediately outboard of such first vertical support member, and such secondary support member being integrally affixed in a position immediately outboard of such second main vertical support member, and longitudinally extending bar means affixed between such first and second main vertical support member, such bar member being affixed in the first transverse openings of such first main support member and such second support member, such bar member being adapted to connect to a pair of hook-like ears on the rear portion of the attached work element.

In further summary, it is to be noted that the subject invention is utilized as follows: The rod 160 positioned at the end of boom 50, is pivotably connected to the coupling member 200, as seen in FIGS. 2 and 6. This aspect pivotably connects the coupler to the end of boom 50 through rod 160. The lower end of boom 50 is connected to the coupling member along axis B-B in FIG. 6.

The coupling member 200 is then, in turn, connected to the loading bucket 900 as follows: The openings 865A, 865B on the coupling member 200, through which imaginery axis D-D is situated, are aligned with the openings 920A and 920B in the ears 980A and 980B on the rear face of the loading bucket 900 so that a cylindrical pin 965 can be inserted therethrough to secure the coupling member 200 to the loading bucket 900 after the hook members 950A and 950B on the rear face of loading bucket 900 are placed conformingly over the cylindrical bar member 520 of the coupling member 200.

I claim:

1. A universal coupling device attached to the front end of a motor vehicle for attachment of various work implements to said work vehicle, said device coupling drive comprising:

(a) a longitudinally extending base member having a longitudinal central axis;

(b) first main support member and second main support member, each said main support members having an upper portion and a lower portion, both said support members being vertically disposed members being parallel to one another in tandem fashion, both said main support members diverging downwardly from substantially their midpoints and being integrally affixed on their respective lower portions to said base member, said first main support member and said second main support member each having a transverse opening in the upper portion wherein said transverse opening in the upper portions of said first and second main support members are coaxially aligned along a common axis, and wherein said first main support member and said second main support member each having a second transverse opening disposed in that portion of the vertical main support members at a portion thereof above the base support member, said second transverse openings in such respective main support members being coaxially aligned along a common axis;

(c) a first secondary vertical support member and a second secondary vertical support member with the first such secondary vertical support member being integrally affixed in a position immediately outboard of said first main vertical support member, and said second secondary vertical support member being integrally affixed in a position immediately outboard of said second main vertical support member, said first and second main vertical support members each having three sets of openings therein, each set aligned along a common axis, with one such set being adapted to hold a connecting pin for attaching the coupling member to the front end of the motor vehicle, with said first and second main vertical support members each having outwardly turned upper portions, each said first and second secondary support members comprising at least one opening aligned with one set of said openings in said first and second main support members for co-operation therewith for securing one of said vehicle and attachment to said coupling device;

(d) a longitudinally extending bar member affixed between said first and second main vertical support members, said bar member being affixed in the first transverse openings of said first main vertical support member and said second main vertical support member, said bar member being adapted to connect to a pair of hook-like ears on the rear portion of the attached work implement.

2. A universal coupling device attached to the front end of a motor vehicle for attachment of various work implements to said work vehicle, said device coupling device comprising:

(a) a longitudinally extending base member having a longitudinal central axis;

(b) first main support member and second main support member, each said main support members having an upper portion and a lower portion, both said support members being vertically disposed members being parallel to one another in tandem fashion, both said main support members diverging downwardly from substantially their midpoints and being integrally affixed on their respective lower portions to said base member, said first main support member and said second main support member each having a transverse opening in the upper portion wherein said transverse opening in the upper portions of said first and second main support members are coaxially aligned along a common axis, and wherein said first main support member and said second main support member each having a second transverse opening disposed in that portion of the vertical main support members at a portion thereof above the base support member, said second transverse openings in such respective main support members being coaxially aligned along a common axis;

(c) a first secondary vertical support member and a second secondary vertical support member with the first such secondary vertical support member being integrally affixed in a position immediately outboard of said first vertical main support member, and said second secondary vertical support member being integrally affixed in a position immediately outboard of said second main vertical support member, said first and second main vertical support members each having three sets of openings therein, each set aligned along a common axis, with one such set being adapted to hold a connecting pin for attaining the coupling member to the front end of the motor vehicle, with said first and second main vertical support members each having outwardly turned upper portions, each said first and second secondary support members comprising at least one opening aligned with one set of said openings in said first and second main support members for co-operation therewith in securing one of said vehicle and attachment to said coupling device;

(d) a longitudinally extending bar member affixed between said first and second main vertical support members, said bar member being affixed in the first transverse openings of said first main support member and said second main support member, said bar member being adapted to connect to a pair of hook-like ears on the rear portion of the attached work implement;

(e) locking means on said coupling member to lock said coupling member to the work implement.

* * * * *